US006397744B1

(12) United States Patent
Jentzsch et al.

(10) Patent No.: US 6,397,744 B1
(45) Date of Patent: Jun. 4, 2002

(54) METHOD AND DEVICE FOR INFLUENCING INK DISTRIBUTION

(75) Inventors: Arndt Jentzsch, Coswig; Uwe Becker, Radebeul, both of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/581,535

(22) PCT Filed: Jan. 7, 1999

(86) PCT No.: PCT/DE99/00036

§ 371 (c)(1),
(2), (4) Date: Aug. 25, 2000

(87) PCT Pub. No.: WO99/34978

PCT Pub. Date: Jul. 15, 1999

(30) Foreign Application Priority Data

Jan. 9, 1998 (DE) ..... 198 00 475

(51) Int. Cl.[7] ..... B41F 31/00
(52) U.S. Cl. ..... 101/352.06
(58) Field of Search ..... 101/352.06, 352.01, 101/352.02, 352.03, 352.04, 352.05, 364, 365, 366, 367, 483, 484, 485, 492, 351.1, 351.3, 351.4, 351.5

(56) References Cited

U.S. PATENT DOCUMENTS

| | | | | | |
|---|---|---|---|---|---|
| 3,301,182 | A | * | 1/1967 | Leviton | 101/351.1 |
| 3,507,215 | A | * | 4/1970 | Schuhmann | 101/351.3 |
| 4,385,539 | A | * | 5/1983 | Jarach | 101/352.06 |
| 4,570,539 | A | * | 2/1986 | Rottstedt | 101/365 |
| 4,872,406 | A | * | 10/1989 | Kusch | 101/352.04 |
| 5,572,210 | A | | 11/1996 | Holl et al. | |
| 5,590,599 | A | * | 1/1997 | Muller et al. | 101/365 |
| 5,826,508 | A | * | 10/1998 | Komori | 101/351.3 |
| 6,112,660 | A | * | 9/2000 | Hans et al. | 101/352.06 |

FOREIGN PATENT DOCUMENTS

| | | |
|---|---|---|
| DE | 37 07 695 | 9/1988 |
| EP | 0 403 861 | 12/1990 |

* cited by examiner

*Primary Examiner*—Eugene Eickholt
(74) *Attorney, Agent, or Firm*—Jones Tullar & Cooper PC

(57) ABSTRACT

Ink distribution to the transfer roller of a printing machine is rapidly influenced. The ink duct roller is driven at a maximum speed and the ink distribution roller is caused to rotate at the ink duct roller speed. The ink vibrator roller is brought ink continuous engagement with these two rollers and is brought out of contact with its oscillating drive mechanism. The ink fountain is closed and excess ink is conveyed back to it. The original speeds of the ink duct roller and the ink distribution roller are re-established and the oscillating drive of the vibrator roller is resumed.

8 Claims, 1 Drawing Sheet

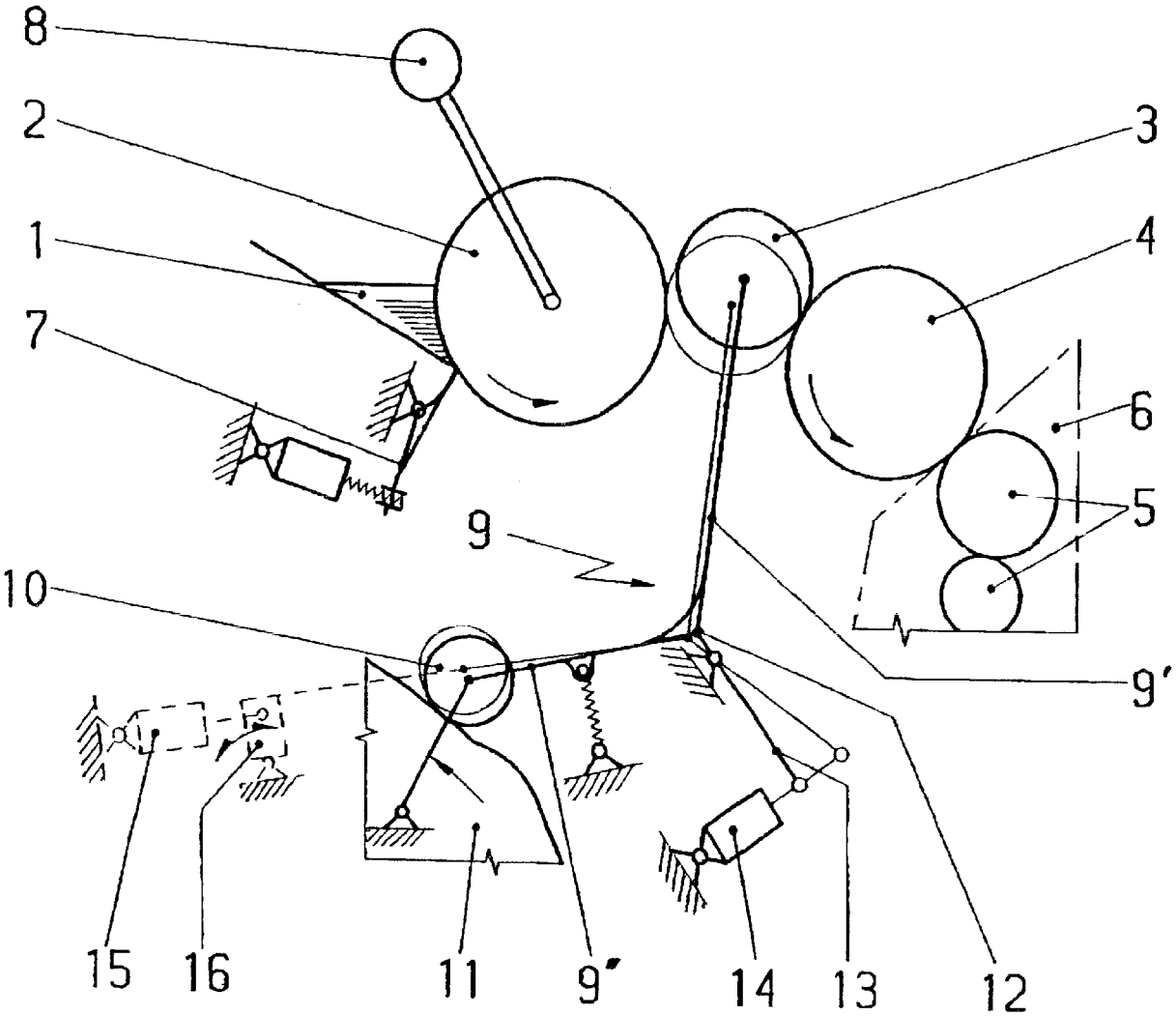
8
2
1
7
10
9
3
4
6
5
9'
12
13
14
9"
11
16
15

METHOD AND DEVICE FOR INFLUENCING INK DISTRIBUTION

FIELD OF THE INVENTION

The present invention relates to a method and a device for affecting the ink distribution in vibrating ink systems of printing presses.

DESCRIPTION OF THE PRIOR ART

Vibrating ink systems are known as shown in EPO 403 861 A1, for example, which have a duct roller circulating in an ink duct, and an ink vibrator roller, which is in operative connection with the duct roller and with a distributing cylinder.

The distributing cylinder is a component of the roller frame of the ink system. The ink vibrator roller periodically swings back and forth between the duct roller and the distributing cylinder and transfers an ink strip from the duct roller to the distributing cylinder. The length of the ink strip is a function of the contact time of the ink vibrator roller with the ink duct and of the speed of rotation of the ink duct.

An effect of the ink distribution in vibrating ink systems of prior art printing presses is known, wherein ink distribution is understood to include the conveying of excess ink back from the rollers of the vibrating ink system into the ink duct at the end of the application, as well as the conveying of additional ink for achieving a new ink profile, constructed on the old ink profile, or the combination of both conveying options.

In connection with a method according to DE-OS 37 07 695, using this effect, with the press rotating, first the ink profile remaining in the ink duct from the previous print application is reduced by closing the ink duct metering elements and, after a defined number of rotations of the ink duct roller, by conveying the amounts of ink zonally present in the ink system as a function of the prior ink profile back to the ink duct, except for a uniformly small, defined ink thickness layer, which is independent of the profile, and which remains on all of the rollers, and thereafter building up the new ink profile corresponding to the new ink application required in the ink system for the subsequent ink application by zonally adjusting the ink metering elements of the ink duct, by setting the length of the ink strip to be transferred into the ink system, and by a defined number of ink system revolutions.

It is a limitation of this prior arts method that affecting the ink distribution in vibrating damping systems is a time-consuming process because of the discontinuous mode of operation of the ink vibrator.

A device has become known from "Patent Abstracts of Japan, vol. 6, no. 213 (M-167), Oct. 26, 1982", and JP 57-120443, which consists of an ink duct roller, an ink-receiving distribution cylinder and an ink vibrator roller that swings back and forth between the ink duct roller and the ink-receiving distributing cylinder. The ink vibrator roller is seated on an end of a lever, and a cam roller, which cooperates with a cam, is arranged on the other end of the lever. The lever is displaced for establishing an operative connection between the ink duck roller, the ink vibrator roller and the ink-receiving distributing cylinder. The operative connection between the ink duct roller, the ink vibrator roller and the ink-receiving distributing cylinder, which then exists, consists in that the ink vibrator roller, which moves back and forth during the running of the press, remains in only a position in which there is a continuous contact between the ink duct roller and the distributing cylinder receiving the ink. Such a position is needed for including the ink vibrator roller and the ink duct roller in a washing operation of the ink system. This prior art publication does not provide any incentive for affecting the ink distribution in vibrating dampening systems.

SUMMARY OF INVENTION

It is the object of the present invention to provide a method and a device for affecting the ink distribution in printing presses in a short time.

In accordance with the invention, this object is attained by the varying of the speeds of the ink duct roller, the ink distributing roller and the ink vibrator roller. The ink vibrator roller is provided with a support that can be positioned so that the ink vibrator roller can be driven continuously at a maximum speed by the ink duct roller and by the ink distributing roller or cylinder.

BRIEF DESCRIPTION OF THE DRAWINGS

The present invention will be described in greater detail in what follows by means of an exemplary embodiment.

A vibrating ink system of a printing press is represented in the sole drawing which is a schematic side elevation view of an ink distribution system in accordance with the present invention.

DESCRIPTION OF THE PREFERRED EMBODIMENT

The vibrating ink distribution system consists of an ink duct 1 with an ink duct roller 2, an ink vibrator roller 3, an ink distributing cylinder 4 and a roller frame 6, which is arranged downstream of the distributing cylinder 4 and which contains several rollers 5.

The ink duct 1 is equipped with mechanically driven color ink profile setting devices 7. The ink duct roller 2 is connected with a drive motor 8, which can drive the ink duct roller in a step by step manner and also continuously at different speeds.

The ink distributing cylinder 4 is equipped with a drive gear, not specifically represented, which is a part of the drive gear train of the printing press. The speed of rotation the ink distributing roller or cylinder 4 can be changed by varying the speed of the printing press.

The ink vibrator roller 3 is seated in a first lever arm 9' of an elbow lever 9. The second lever arm 9" of the elbow lever 9 supports a cam roller 10, which is in operative connection with a cam 11.

The elbow lever 9 is supported at a fulcrum 12. This fulcrum 12 is, in turn, arranged in a pivot lever 13, which is, connected with an actuating member 14.

The geometric arrangement of the elbow lever and the pivot lever are selected in such a way that the establishment of the operative connection between the ink duct roller/ink vibrator/distributing cylinder is accomplished by the removal of the cam roller 10 from contact with the cam 11.

The removal of the cam roller 10 from contact with the can 11 also possible by use of a ratchet 16 via a movement element 15.

The method for affecting the ink distribution quickly and reactively, in accordance with the present invention includes the following method steps.

The ink duct roller 2 is accelerated to maximum speed; the ink duct roller or cylinder drive motor 8 is appropriately triggered to accomplish this.

The distributing cylinder 4 is now brought to a speed which corresponds to the speed of the ink duct roller. This is accomplished by matching the speed of the printing press.

The ink vibrator roller 3 is placed into operational contact with the ink duct roller 2, as well as with the distributing cylinder 4, as shown in the dashed representation in the drawing). At the same time, the cam roller 10 is moved away from the cam 11, and the swing drive for the ink vibrator roller 3 is stopped by this.

These operations are accomplished by the actuating member 14.

The establishment of an operational connection between the ink duct roller, the ink vibrator and the distributing cylinder is alternatively also possible by displacing and/or pivoting the ink duct, including the ink duct roller, in the direction toward the ink vibrator.

The ink duct 1 is now closed by operation of the ink profile setting device 7, so that no ink is now conveyed to the subsequent rollers.

The excess ink is now conveyed by the rollers back in the direction toward the ink duct thus balancing the thicknesses of the ink layers.

After the excess ink has been conveyed back into the ink duct, the speed of the ink duct roller and of the distributing roller are again brought to the speed required for the printing process.

The original function of the ink vibrator is simultaneously reactivated.

It is achieved, by these method steps, that excess ink is conveyed back into the ink duct in the fastest way, i.e. within only a few revolutions.

If the ink profile is to be changed to a new ink profile simultaneously during the application change, the following method steps are required.

The ink duct roller 2 is accelerated to maximum speed; the drive motor 8 is appropriately triggered to accomplish this.

The distributing cylinder 4 is now brought to a speed which corresponds to the speed of the ink duct roller. This is accomplished by increasing the speed of the printing press.

The ink vibrator roller 3 is placed into operational contact with the ink duct roller 2, as well as with the distributing cylinder 4, as shown in the dashed representation in the drawing). At the same time, the cam roller 10 is moved away from the cam 11, and the swing drive for the ink vibrator roller 3 is stopped by this.

These operations are accomplished by the actuating member 14.

Here, too, the displacement and/or pivoting of the ink duct is also alternatively possible, as previously described.

The new ink profile is now set at the ink duct 1 by operation of the ink profile setting device 7.

If excess ink is present, it is now conveyed by the rollers back in the direction toward the ink duct thus balancing the thicknesses of the ink layers. If additional ink on the rollers is necessary, in accordance with the new ink profile, it is conveyed by the ink duct roller to the rollers. The two described processes can also run simultaneously, depending on the requirements.

After this process is finished, the speed of the ink duct roller and of the distributing cylinders is again brought to the speed required for the printing process.

The original function of the ink vibrator is simultaneously reactivated.

If a known ink roller separation during interruption of printing has been integrated into the above roller frame 6, it is useful to suspend this roller separation during the described method steps.

It is furthermore useful to move the ink application rollers, not specifically represented, away from the printing forme cylinder during this process.

While preferred embodiments of a method and a device for influencing ink distribution in a vibrating ink system of a printing press in accordance with the present invention have been set forth fully and completely herein above, it will be apparent to one of skill in the art that a number of changes in, for example the overall sizes of the various rollers and cylinders, the drive assembly for the press and the like could be made without departing from the true spirit and scope of the present invention which is accordingly to be limited only by the following claims.

What is claimed:

1. A method for affecting the ink distribution in a vibrating ink system of a printing press including:

providing an ink duct roller in the vibrating ink system;

driving said ink duct roller at a maximum speed;

providing an ink distributing roller in the vibrating ink system and driving said ink distributing roller at a speed of the printing press;

driving the printing press and said distributing roller at a speed matching the speed of said ink duct roller;

providing an ink vibrator roller having an ink vibrator swing drive;

establishing continuous operative contact between said ink duct roller, said ink vibrator roller and said ink distributing roller;

stopping said ink vibrator swing drive;

providing an ink duct having ink profile setting devices;

closing said ink duct ink profile setting devices;

conveying excess ink from said vibrating ink system into said ink duct;

changing speeds of said ink vibrator roller and the printing press; and restoring the original swing drive function of said ink vibrator roller.

2. The method of claim 1 further including an ink roller separation system in the printing press and suspending said ink roller separation system during said affecting of ink distribution.

3. The method of claim 1 further including moving said ink vibrator roller into a position between said ink duct roller and said distributing roller during said establishing of said continuous operative contact.

4. The method of claim 1 including moving said ink duct and said ink duct roller in a direction toward said ink vibrator during said establishing of said continuous operative contact.

5. A method for affecting the ink distribution in a vibrating ink system of a printing press including:

providing an ink duct roller in the vibrating ink system;

driving said ink duct roller at a maximum speed;

providing an ink distributing roller in the vibrating ink system and driving said ink distributing roller at a speed of the printing press;

driving the printing press and said ink distributing roller at a speed matching the speed of said ink duct roller;

providing an ink vibrator roller having an ink vibrator swing drive;

establishing continuous operative contact between said ink duct roller, said ink vibrator roller and said ink distribution roller;

providing an ink duct having ink profile setting devices;

setting said ink duct to a new ink profile using said ink profile setting devices;

conveying excess ink from said vibrating ink system to said ink duct;

conveying ink to said vibrating ink system from said ink duct in accordance with said new ink profile;

changing speeds of said ink vibrator roller and the printing press; and restoring the original swing drive function of said ink vibrator roller.

6. The method of claim 5 further including an ink roller separation system in the printing press and suspending said ink roller separation system during said affecting of ink distribution.

7. The method of claim 5 further including moving said ink vibrator roller into a position between said ink duct roller and said distributing roller during said establishing of said continuous operative contact.

8. The method of claim 5 including moving said ink duct and said ink duct roller in a direction toward said ink vibrator during said establishing of said continuous operative contact.

* * * * *